US006742285B2

(12) United States Patent
Shepard

(10) Patent No.: US 6,742,285 B2
(45) Date of Patent: Jun. 1, 2004

(54) AIR KNIFE AND CONVEYOR SYSTEM

(75) Inventor: Robert R. Shepard, Magadore, OH (US)

(73) Assignee: Glass Equipment Development, Inc., Twinsburg, OH (US)

( * ) Notice: Subject to any disclaimer, the term of this patent is extended or adjusted under 35 U.S.C. 154(b) by 0 days.

(21) Appl. No.: 10/352,010

(22) Filed: Jan. 27, 2003

(65) Prior Publication Data

US 2003/0172547 A1 Sep. 18, 2003

Related U.S. Application Data

(60) Provisional application No. 60/365,500, filed on Mar. 18, 2002.

(51) Int. Cl.[7] ..... F26B 13/00

(52) U.S. Cl. ..... 34/611; 34/629; 34/641; 34/241

(58) Field of Search ..... 34/611, 629, 641, 34/241

(56) References Cited

U.S. PATENT DOCUMENTS 3,587,177 A * 6/1971 Overly ..... 34/641
5,016,363 A * 5/1991 Krieger ..... 34/641
5,395,029 A * 3/1995 Kurie ..... 242/615.11
5,659,972 A * 8/1997 Min et al. ..... 34/255
6,431,858 B1 * 8/2002 Rutz ..... 432/59

* cited by examiner

*Primary Examiner*—Jiping Lu
(74) *Attorney, Agent, or Firm*—Watts Hoffman Co., L.P.A.

(57) ABSTRACT

An air knife constructed in accordance with the present invention directs a curtain of air across a region and most typically is used to direct the stream of air against a surface. In an exemplary embodiment of the invention the air knife includes an elongated housing having an inlet for receiving air into the housing. The housing includes an elongated gap that extends along the housing that allows air entering the housing through the inlet to exit the housing and form a curtain of air. The elongated housing is made from a piece of sheet metal bent to define a hollow region into which air is forced. The sheet metal defines a gap along a length of the housing from which the air exits. The elongated air knife forms an angle with respect to a direction of travel of glass sheets passing the air knife so that a leading edge of those glass sheets passes progressively different parts of the air knife.

22 Claims, 5 Drawing Sheets

AIR KNIFE AND CONVEYOR SYSTEM

CROSS REFERENCE TO RELATED APPLICATIONS

The present application claims priority from provisional application serial No. 60/365,500 filed Mar. 18, 2002 entitled "Air Knife".

FIELD OF THE INVENTION

The present invention concerns an air knife for directing a stream of air against a surface. One application for the invention is for applying air against moving pieces of glass for use in fabricating windows.

BACKGROUND ART

Existing air knives direct air at a high velocity from an elongated housing to create a curtain of air that can be directed against a surface. In the art of window fabricating, glass sheets are shipped from a supplier, unloaded, cut, and washed. The washing process removes a packing material, such as Lucor, that makes the glass sheets easier to separate from each other. The washing process also cleans the glass so that adhesives properly adhere to the glass sheets after they exit the washer. The sheets are dried by an air knife and moved to another fabrication station where, for example, they are assembled into a door, a window, or an insulating glass unit.

Existing or prior art air knives greatly increase noise levels in the region in which they operate. Such noise is due to the fact that the air escaping from a chamber or housing creates a first sound and additionally a blower that delivers air to the prior art air knife adds to the noise. The combined noise from the air knife and the blower can be loud enough to require operators in the vicinity of the glass washer to wear ear plugs to lower the noise level the worker experiences. Additionally, use of high power blowers adds to the expense of operating these prior art air knives. Existing air knives are constructed using extruded tubes that are assembled into a completed air knife. One goal of the invention is to provide an efficient and less costly air knife than existing commercially available air knives.

SUMMARY OF THE INVENTION

An air knife constructed in accordance with the present invention directs a stream of air across a region and most typically is used to direct the stream of air against a surface. In an exemplary embodiment of the invention the air knife includes an elongated housing having an inlet for receiving air into the housing. The housing includes an elongated gap that allows air entering the housing through the inlet to exit the housing and form a stream of air. The elongated housing is made from one or more pieces of sheet metal bent to define a hollow region into which air is forced. The sheet metal defines a gap along a length of the housing from which the air exits.

Another aspect of the invention is a method of fabricating an air knife including providing a sheet of metal having a length substantially equal to a length of the air knife. A housing is formed by bending the sheet metal and bringing opposing edges of the sheet metal into spaced relation with each other to form a gap through which air can escape from an interior of the housing during operation of the air knife. The interior region of the housing is coupled to a source of pressurized air so that air exiting the housing forms a stream of air that passes through a controlled region in relation to the housing.

The exemplary embodiment of the invention is for use in drying a sheet of material that moves in relation to the air knife. Other uses of the knife will be readily apparent to those having applications that require a directed stream of air that passes through a region. The disclosed air knife operates at a noise level lower noise level than prior systems and which is low enough to enable an operator to stand in the vicinity of the air knife without wearing special ear plugs and also without the use of expensive muffling equipment for the blower.

An exemplary air knife is made from two elongated bent pieces of sheet metal that are bent to form two members that mate to form a housing. A third member that is also made from an elongated sheet of metal form an elongated nozzle that defines the gap which extends along a length of said housing. In this construction, the first and second members form a first chamber into which air is delivered by a blower and the third member combines with one of said first and second members to define a second chamber which receives air from the first chamber and dispenses air through the gap to form a stream of air.

The resulting structure can be built more cheaply than existing air knives. It is believed that the cost per unit length of air knives constructed in accordance with an exemplary embodiment of the invention can be made at significantly reduced costs.

These and other objects, advantages and features of the invention will become better understood from a review of an exemplary embodiment of the invention which is described in conjunction with the accompanying drawings.

EXEMPLARY MODE FOR PRACTICING THE INVENTION

Figure 1:
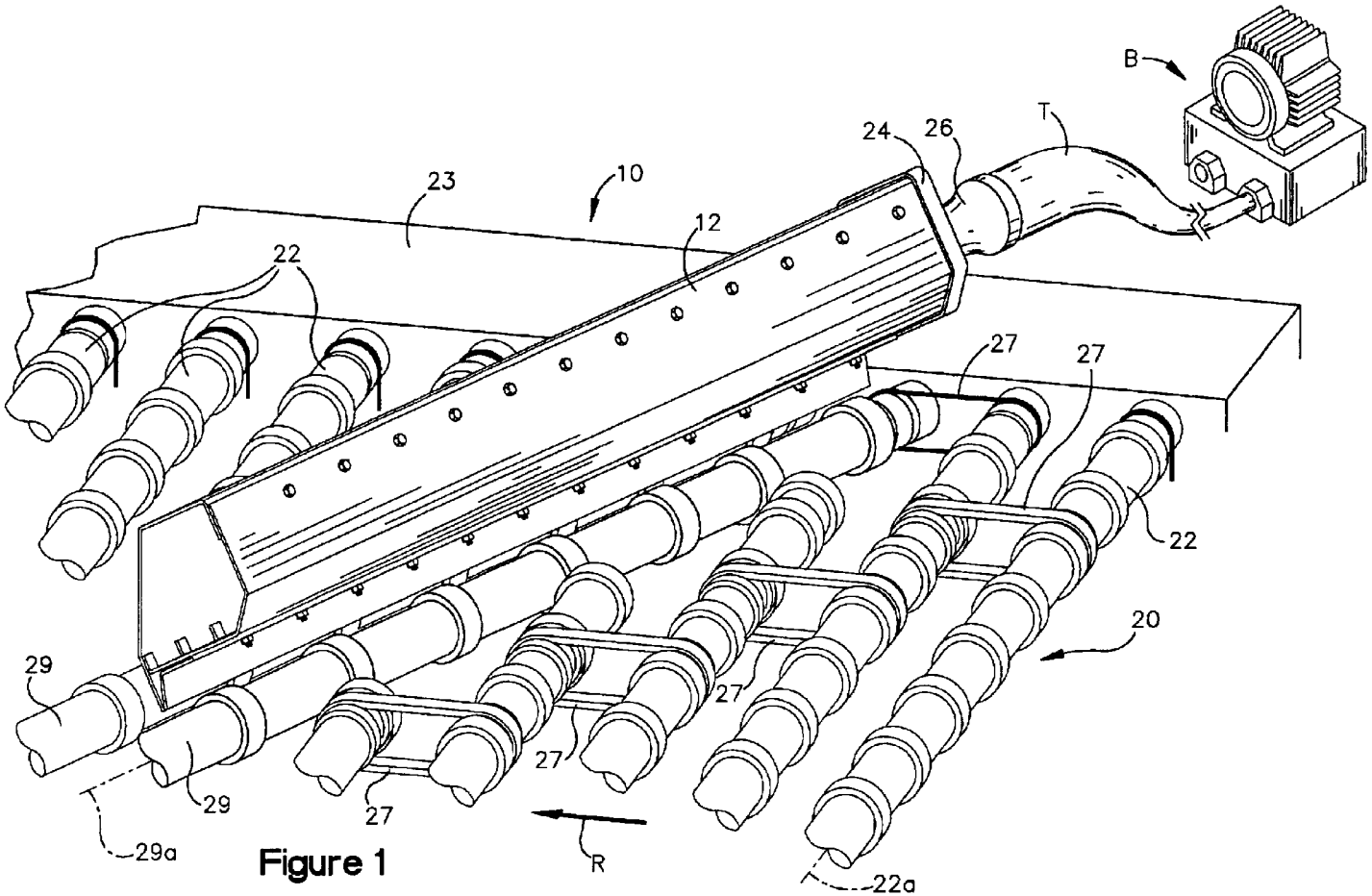
FIG. 1 is a fragmentary perspective view of an air knife coupled to a blower which forces air into the air knife.

Turning to the drawings, FIG. 1 depicts a fragmentary perspective view of an air knife 10 constructed in accordance with the present invention. The exemplary air knife 10 receives air moving at a high velocity from a blower B that directs air through a tube T into an elongated housing 12 of the knife 10. An elongated gap 14 (See FIGS. 4 and 5) along the side of the housing 12 allows air to escape from the housing to create a curtain 16 of air that can be directed against a surface of an object 18 such as a sheet of glass.

In the art of window fabricating, glass sheets come from a supplier and are unloaded and washed to remove a packing material, such as Lucor, that makes the glass sheets easier to separate from each other. As the glass leaves a washer 19, it is moved by a conveyor 20 made up of individual rollers 22 to a position with respect to the air knife 10 where the air curtain 16 is directed down onto the glass. For this use, a second air knife (FIGS. 4 and 5) is positioned to direct a stream of air upwardly from below the conveyor 20 so that both top and bottom surfaces of the glass sheets would be dried prior to transfer to another processing station such as an assembly station where glass sheets are assembled into items such as windows, doors, furniture, and insulated glass units.

The fragmentary perspective view of FIG. 1 illustrates one end of the air knife 10 with an end plate 24 that defines an inlet into the housing and coupling 26 that connects the tube T to the air knife 10. An opposite end of the air knife (See FIG. 2) is covered with a cover plate 25 that allows the air pressure from the air entering the knife to build up and cause air to flow from the housing 12. In an alternate configuration, both ends of the elongated housing have air inlets for one or multiple air sources such as the blower B.

Figure 2:
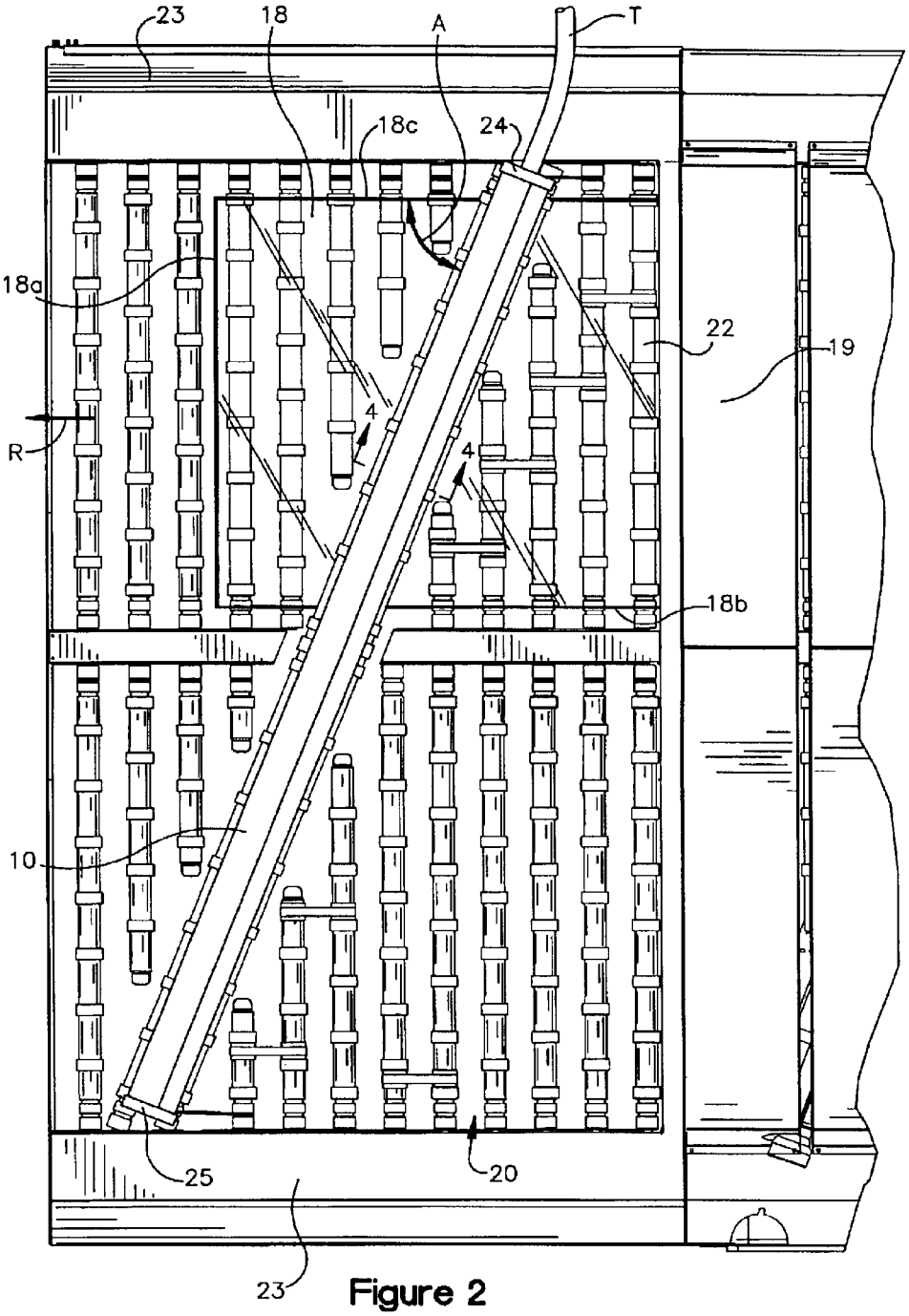
FIG. 2 is a top plan view of the exemplary embodiment of the air knife of FIG. 1 showing rollers for transporting glass sheets past the air knife.

As seen in the depiction of FIG. 2, the air knife 10 is positioned with respect to a glass washer to blow liquid from a surface of a glass sheet that has been cleaned by the glass washer 19. In the disclosed embodiment there are two air knives 10, 10*a* (See FIGS. 4 and 5) with one blowing air against a top surface of a sheet 18 and a second blowing air against a bottom surface.

A first set of driven rollers 22 are mounted to a support 23 for rotation and are aligned parallel to each other having axes of rotation 22*a*. When rotated these rollers move a glass sheet 18 in a travel path direction away from a glass washer as indicated by the arrow R in FIGS. 1 and 2. Generally the washer is used to wash rectangular shaped pieces of glass which have a leading edge 18*a* that advances through a region between the air knives 10, 10*a* and is generally perpendicular to the travel direction R. Sides 18*b*, 18*c* are generally parallel to each other and also remain parallel to the travel direction R.

A drive is coupled to the driven rollers 22 by means of a linkage (not shown). A series of belts 27 interconnect the driven rollers 22 so that a single connection between the drive and a first driven roller 22 coupled to the linkage. The air knife 10 is mounted to the support 23 to direct a stream of air through a region to contact the glass sheet 18 as it moves away from the glass washer 19 so that air exiting the air gap 14 forms an air curtain that contacts the glass sheet. The elongated gap 14 that extends along the housing forms an angle A with respect to the travel path direction R. As the leading edge of the glass sheet 18 moves through the air curtain, the air curtain contacts progressively different parts of the glass sheet's leading edge as the rollers 22 move the glass sheet away from the washer. As seen in the top plan view of FIG. 2, for example, the leading edge 18*a* contacts a region of the air curtain nearest the tube T from the blower B and as the sheet 18 progresses forward other parts of the leading edge pass underneath the curtain until the leading edge portion nearest the side 18*b* passes underneath the air curtain.

A second set of two rollers 29 are mounted to the support 23 and have a rotation axis 29*a* that is generally parallel to the gap 14 that extends along a length of the air knife housing. In the illustrated embodiment, these rollers 29 rotate in synchronism with the parallel aligned rollers 22. A space S between the two rollers allows the air curtain of the lower air knife 10*a* to pass through the conveyor. As a result, air curtains are directed against both the top and the bottom of the sheet 18.

Figure 3:
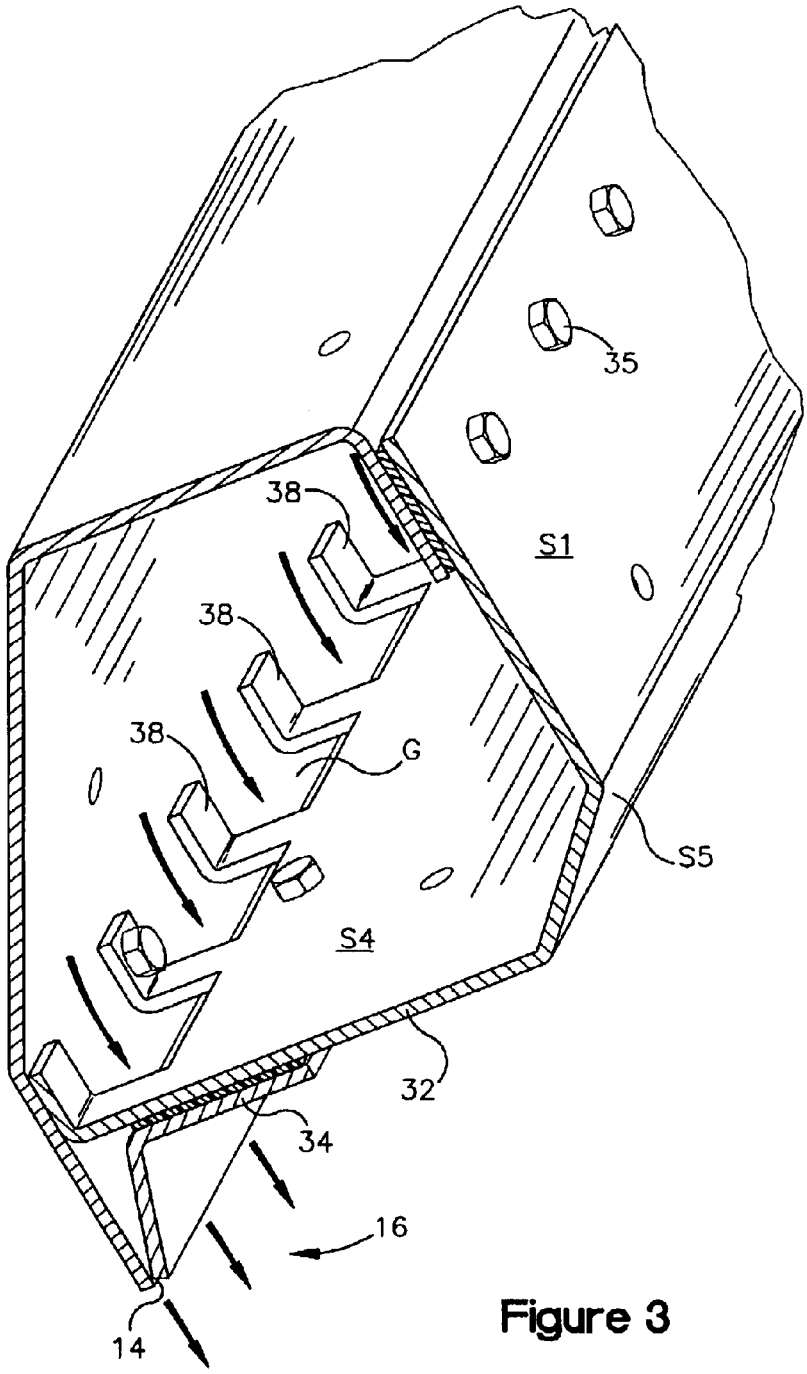
FIG. 3 is a perspective view of a housing made from three pieces of sheet metal bent to form an air knife housing.
Figure 4:
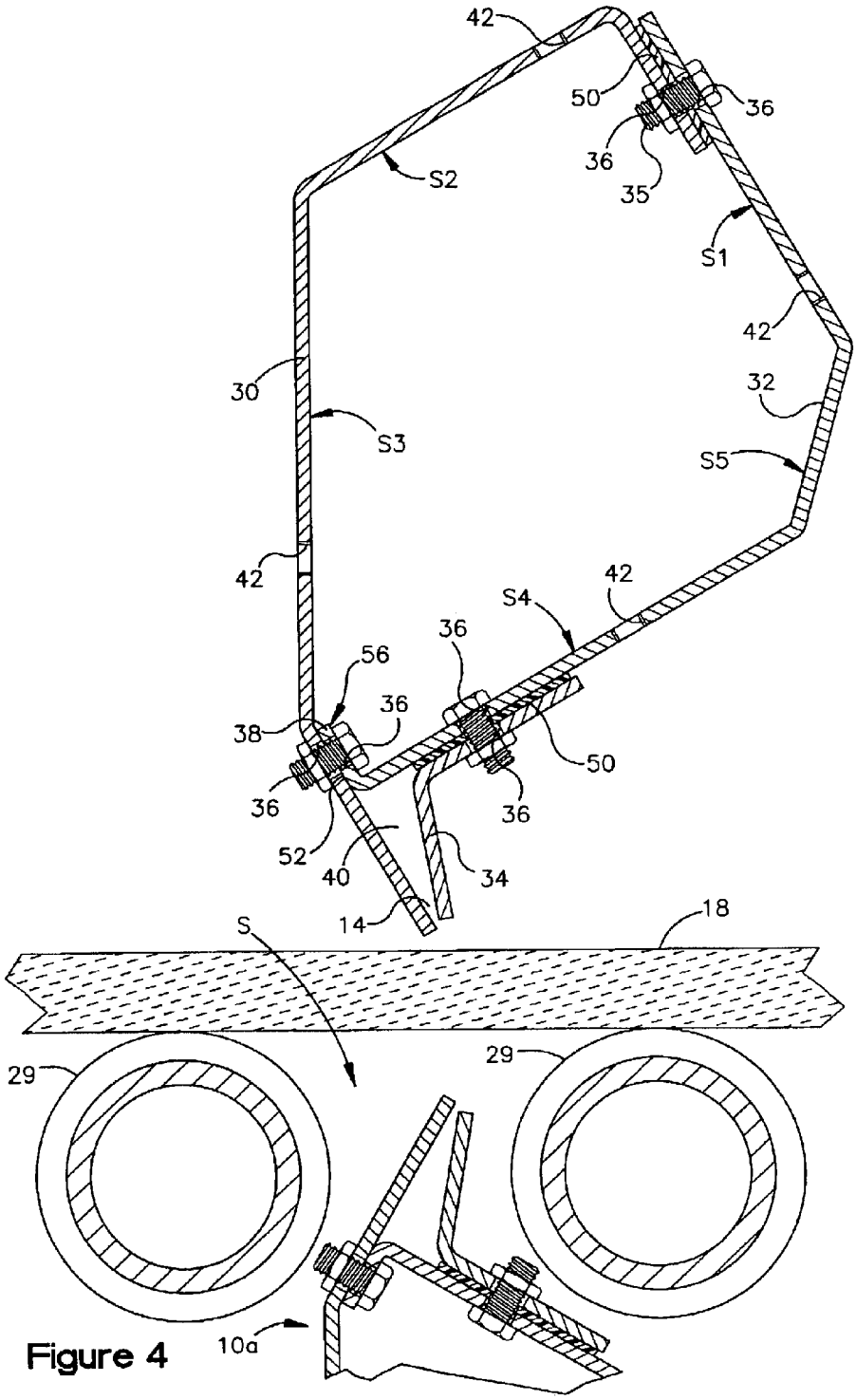
FIG. 4 is a section view of an air knife positioned relative to a sheet of glass.
Figure 5:
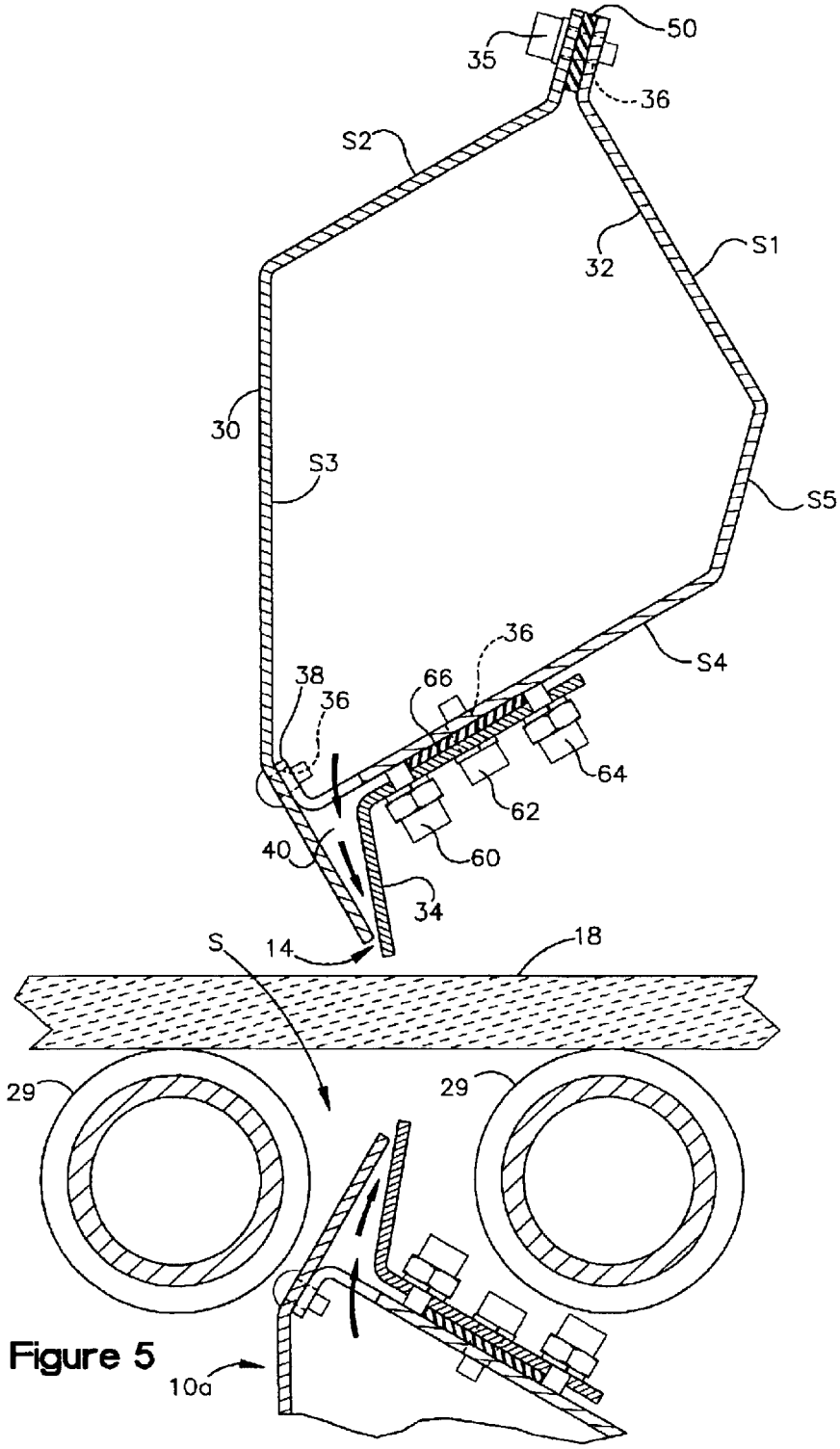
FIG. 5 is a section view of an alternate embodiment of an air knife positioned relative to a sheet of glass.

As seen in the perspective view of FIG. 3 and the section view of FIGS. 4 and 5, the exemplary housing is constructed from three bent metal sheets 30, 32, 34. In this exemplary embodiment, the three metal sheets are connected together by means of screw 35 that extend through openings 36 in one member and that engage threaded holes in another member. The screws are tightened to rigidly connect the three members together. Means other than screws for interconnecting the three members are contemplated. Welding and gluing are alternative options. In the exemplary embodiment of the invention, the members 30, 32, 34 are constructed from stainless steel that is punched and then bent to the configurations depicted in the drawings.

The exemplary housing 12 includes five interior surfaces S1–S5 that extend along a length of the air knife 10. A corner of the housing 12 defined by the intersection of the two sides S4 and S3 has a series of gaps G defined by fingers 38 (FIG. 3) in the member 32 spaced along its length at generally right angles with respect to the surface S4. The gaps G allow pressurized air entering the housing 12 to exit the housing bounded by the walls S1–S5 and enter a chamber 40 bounded by the two members 30, 34. This chamber 40 necks down to a narrow gap 14 or slot that extends along the length of the housing 12 so that air exiting the gap forms a curtain of air.

Turning to FIG. 3, this end view depicts one of the fingers 38 that allows the member 32 to attach to the member 30 by means of appropriate connectors such as the bolt and nut connectors mentioned above. As seen in FIG. 3, the finger 38 defines a hole or opening 36 which aligns with a similar hole in the member 30. As seen in FIG. 3 the members also including openings 42 that are not aligned with other members. These openings 42 are used to mount end caps to the air knife 10.

The width of the air gap 14 is most preferably adjustable to be within a range of 0.005 inch to approximately 0.080 inch. In one embodiment of the invention, the adjustment is achieved by moving the member 34 in a direction parallel to the surface S4 to open and close the gap 14. This would be accomplished by use of a slot in the member 34 which would allow the position of the member 34 with respect to the member 32 to be adjusted and then fixed by tightening the screw until the relative position of the two members is securely fixed.

In accordance with the embodiment of FIG. 4, the spacing of the gap 14 is controlled by use of a compressible gasket material. A compressible gasket 50 is trapped between the region of engagement between the member 30 and the member 32 so that by tightening and loosening the screw 35 (See FIG. 3) the width of the gap 14 is controlled. As an alternative embodiment, a gasket (not shown) is trapped between an outer surface 52 of the fingers 38 and an inner surface of the member 30 in the region of the fingers. This gasket material is also compressible and by loosening and tightening the connectors that pass through the openings 36 the gasket compression is controlled and a spacing between the member 34 and the member 30 is adjusted in the region of the gap 14. Other gaskets are used to impede leakage of air from the housing interior at interfaces between the members 30, 32, 34 in the region of openings through which the bolts extend. Similarly, gaskets can be used to seal the interfaces between these members and an end plate at one end of the housing and the end plate 24 that defines the air inlet into the housing.

FIG. 5 illustrates an alternate way of controlling the gap spacing. In this embodiment, the member 34 is tilted about a pivot axis that generally co-incides with a connector 62 that passes through an opening 36 in the member 34 as well as a gasket 66 of flexible, resilient material and into the member 32. Threaded connectors 60, 64 on either side of the connector 62 are loosened and tightened to adjust the gap spacing 14 and thereby adjust air flow through the gap.

The preferred material of the members 30, 32, 34 is stainless steel but other material such as aluminum could be used so long as it is capable of being cut or punched to a certain configuration and then bent to form the proper angles to form the housing. A preferred blower B is model VB-075 Vortex Blower that is commercially available from the Specer Turbine Company of Windsor Conn. 06095-4706. In the presently preferred embodiment of the invention, the angle A that the air knife 10 makes with the path of travel R is fixed and is approximately 45 degrees. Other ranges of this angle are possible and it is possible that through a rail mounting system the angle the air knife makes with the conveyor rollers could be adjusted to increase the removal of water from the surface of the glass sheets exiting the washer.

While a preferred embodiment of the invention has been described with a degree of particularity, its is the intent that the invention include all modifications and alterations from the disclosed design falling within the spirit or scope of the appended claims.

What is claimed:

1. An air knife for directing a curtain of air against a surface of a sheet of glass, comprising:

a) an elongated housing having an inlet for receiving air into the housing, said housing defines an elongated gap that allows air entering the housing through the inlet to exit the housing and form a curtain of air;

b) said elongated housing constructed from one or more pieces of sheet metal bent to define a hollow region into which air is forced and said gap extending along a length of the housing from which the curtain of air exits and is directed against a surface of a sheet of glass.

2. The air knife of claim 1 wherein the housing comprises two elongated bent pieces of sheet metal that are bent to form two wall defining members that mate to form said housing.

3. The air knife of claim 1 additionally comprising a blower for delivering air into an interior of said housing to force air from said gap.

4. An air knife for directing a stream of air through a region comprising:

a) an elongated housing having an inlet for receiving air into the housing, said housing defines an elongated gap that allows air entering the housing through the inlet to exit the housing and form a curtain of air;

b) said elongated housing constructed from two elongated bent pieces of sheet metal that are bent to form two wall defining members that mate to form said housing and define a hollow region into which air is forced and said gap extending along a length of the housing from which the air exits, wherein one member defines spaced fingers that extend away from an edge of one wall defining member to space said edge away from a corresponding surface of a second wall defining member and thereby define said gap through which air under pressure exits said housing.

5. The air knife of claim 4 additionally comprising a compressible material that seals an interface between said first and second members.

6. The air knife of claim 4 additionally comprising connectors that attach the first and second members to each other along a length of said housing.

7. The air knife of claim 6 wherein said connectors extend through the spaced fingers that extend away from an edge of said one member to attach said one member to the second member along an extent of said gap.

8. The air knife of claim 7 wherein the connectors that extend through the spaced fingers can be loosened or tightened to adjust the flow of air through the gap.

9. The air knife of claim 4 wherein the a third member is movably connected to one of said first and second members and can be moved to adjust the gap through which air exits the housing.

10. The air knife of claim 4 wherein a third member is connected to one of said first and second members and can be pivoted in its engagement with said one member to adjust the gap through which air exits the housing.

11. An air knife for directing a stream of air through a region comprising:

a) an elongated housing having an inlet for receiving air into the housing, said housing defines an elongated gap that allows air entering the housing through the inlet to exit the housing and form a curtain of air;

b) said elongated housing constructed from two elongated bent pieces of sheet metal that are bent to form two wall defining members that mate to form said housing and are bent to define a hollow region into which air is forced and said gap extending along a length of the housing from which the air exits; and c) a third member made from an elongated sheet of metal which combines with one of said first and second wall defining members to form an elongated nozzle that defines the gap which extends along a length of said housing.

12. The air knife of claim 11 wherein the first and second members form a first chamber into which air is delivered and the third member combines with one of said first and second members to define a second chamber that is in fluid communication with the gap.

13. A method of fabricating an air knife for directing a curtain of air against a surface of a glass sheet, comprising:

a) providing a sheet of metal having a length substantially equal to a length of the air knife;

b) forming a housing by bending the sheet metal and bringing opposing edges of the sheet metal into spaced relation with each other to form a gap through which air can escape from an interior of said housing, form a curtain of air, and be directed against a surface of a glass sheet during operation of said air knife; and c) coupling said interior region of said air knife to a source of pressured air.

14. The method of claim 13 wherein the step of forming a housing is performed by bending two elongated sheet metal members and attaching the two sheet metal members together to form said housing.

15. A method of fabricating an air knife comprising:

a) providing a sheet of metal having a length substantially equal to a length of the air knife;

b) forming a housing by bending two elongated sheet metal members and attaching the two sheet metal members together to form said housing and bringing opposing edges of the sheet metal into spaced relation with each other to form a gap through which air can escape from an interior of said housing during operation of said air knife;

c) coupling said interior region of said air knife to a source of pressured air;

d) inserting a compressible material between conforming surfaces of said two elongated sheet metal members and wherein the members are attached by connectors.

16. A method of fabricating an air knife comprising:

a) providing a sheet of metal having a length substantially equal to a length of the air knife;

b) forming a housing by bending the sheet metal and bringing opposing edges of the sheet metal into spaced relation with each other to form a gap through which air can escape from an interior of said housing during operation of said air knife;

c) attaching an elongated nozzle defining member to the housing to define a chamber next to the gap through which air exits from the housing; and d) coupling said interior region of said air knife to a source of pressured air.

17. A method of generating an elongated curtain of air and directing the curtain of air against a surface of a glass sheet, comprising:

a) blowing air into an elongated chamber having a plurality of gaps along its length through which the air exits said elongated chamber;

b) positioning a second chamber in fluid communication with the elongated chamber to allow air to pass through the plurality of gaps to the second chamber, said second chamber having an elongated narrow gap along a portion of said elongated chamber through which air flows to allow air to exit from the second chamber to form an air curtain, that is directed against a surface of a glass sheet.

18. Apparatus positioned with respect to a glass washer for blowing liquid from a surface of a glass sheet that has been cleaned by the glass washer comprising:

a first set of driven rollers for moving a glass sheet in a travel path direction away from a glass washer;

an air knife mounted to direct a stream of air through a region to contact the glass sheet as it moves away from the glass washer comprising an elongated housing having an inlet for receiving air into the housing, said housing defining an elongated air gap that allows air entering the elongated housing through the inlet to exit the housing and form an air curtain that contacts the glass sheet;

said elongated air gap extending in a direction that forms an angle with respect to the travel path direction so that the air curtain contacts progressively different parts of said leading edge as the rollers move said glass sheet away from the washer; and a second set of one or more rollers having a rotation axis that is aligned generally with the air gap in said housing but is offset from an angle of rotation of the first set of rollers.

19. The apparatus of claim 18 wherein the elongated housing is constructed from one or more pieces of sheet metal bent to define a hollow region into which air is forced and said gap extending along a length of the housing from which the air exits.

20. The apparatus of claim 18 wherein the air gap is defined by a distance between first and second surfaces of said housing.

21. The apparatus of claim 18 wherein an angle between first and second surfaces of the housing define an air gap for creating the air curtain.

22. The apparatus of claim 18 wherein the elongated housing of the air knife forms an angle of approximately 45 degrees with a path of travel provided by the first set of rollers.

* * * * *

UNITED STATES PATENT AND TRADEMARK OFFICE

CERTIFICATE OF CORRECTION

PATENT NO. : 6,742,285 B2
DATED : June 1, 2004
INVENTOR(S) : Robert Shepherd, II It is certified that error appears in the above-identified patent and that said Letters Patent is hereby corrected as shown below:

Title page,
Item [12], "Shepard" should read -- Shepherd, II --
Item [75], "Inventors: Robert R. Shepard, II Magadore, OH (US)" should read -- Inventors: Robert R. Shepherd, II Magadore, OH (US) --

Signed and Sealed this

Ninth Day of November, 2004

JON W. DUDAS
*Director of the United States Patent and Trademark Office*